US012121955B1

(12) United States Patent
Sallot et al.

(10) Patent No.: US 12,121,955 B1
(45) Date of Patent: Oct. 22, 2024

(54) FOUNDRY CORE FOR MANUFACTURING A HOLLOW METAL AERONAUTICAL PART

(71) Applicant: SAFRAN, Paris (FR)

(72) Inventors: Pierre Jean Sallot, Moissy-Cramayel (FR); Mirna Bechelany, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 18/579,343

(22) PCT Filed: Jul. 12, 2022

(86) PCT No.: PCT/FR2022/051406

§ 371 (c)(1),
(2) Date: Jan. 13, 2024

(87) PCT Pub. No.: WO2023/285766

PCT Pub. Date: Jan. 19, 2023

(30) Foreign Application Priority Data

Jul. 16, 2021 (FR) ..... 2107726

(51) Int. Cl.

| | |
|---|---|
| ***B22C 9/10*** | (2006.01) |
| ***B22C 1/00*** | (2006.01) |
| ***B22C 9/04*** | (2006.01) |
| ***B22D 29/00*** | (2006.01) |

(52) U.S. Cl.
CPC ..... *B22C 1/00* (2013.01); *B22C 9/04* (2013.01); *B22C 9/10* (2013.01); *B22D 29/002* (2013.01); *B22D 29/003* (2013.01)

(58) Field of Classification Search
CPC ..... B22C 1/00; B22C 9/10
See application file for complete search history.

(56) References Cited

U.S. PATENT DOCUMENTS

| | | | | |
|---|---|---|---|---|
| 4,164,424 | A * | 8/1979 | Klug | B22C 9/04 264/43 |
| 4,184,885 | A * | 1/1980 | Pasco | C04B 35/10 164/369 |
| 4,187,266 | A | 2/1980 | Greskovich et al. | |
| 4,221,748 | A * | 9/1980 | Pasco | B22D 27/045 264/43 |

FOREIGN PATENT DOCUMENTS

EP 1764170 A1 12/2011

OTHER PUBLICATIONS

French Search Report issued in French Application FR 2107726 on Mar. 16, 2022 (7 pages).
International Search Report issued in International Application PCT/FR2022/051406 on Nov. 1, 2022 (2 pages).

* cited by examiner

*Primary Examiner* — Kevin E Yoon
(74) *Attorney, Agent, or Firm* — Bookoff McAndrews, PLLC

(57) ABSTRACT

Casting core for the manufacture of hollow metal aeronautical parts, in particular high-pressure turbine parts by lost-wax casting, including a composite material including on the one hand a first phase of formula $M_{n+1}AlC_n$, where n=1 to 3 and M being a transition metal selected from the group consisting of titanium and/or niobium and/or molybdenum, the composite material including on the other hand a second phase of formula $Al_4C_3$.

15 Claims, 3 Drawing Sheets

[Fig. 1]
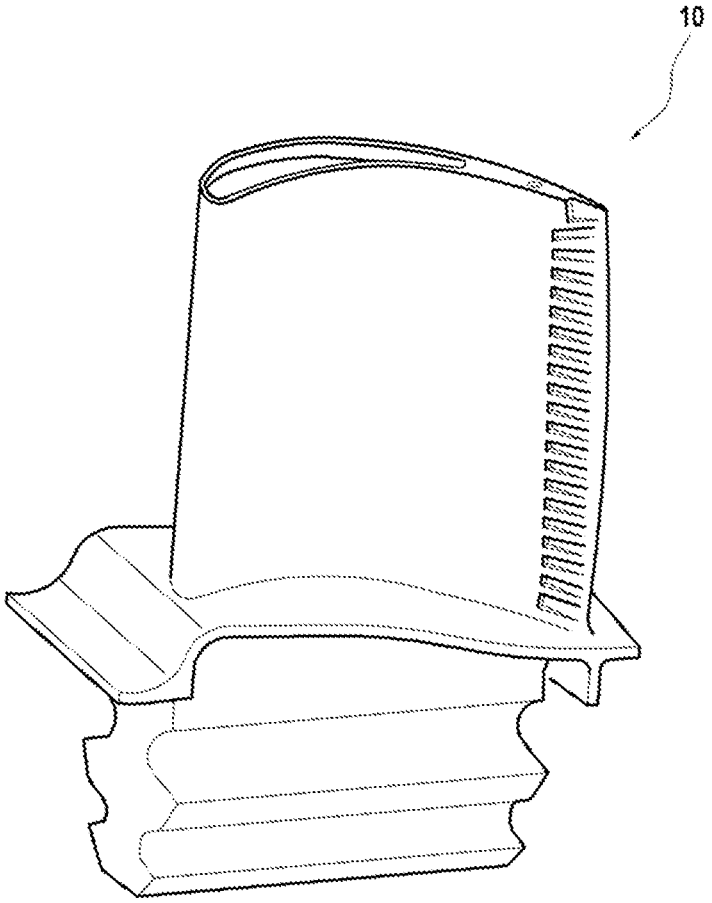
[Fig. 2]
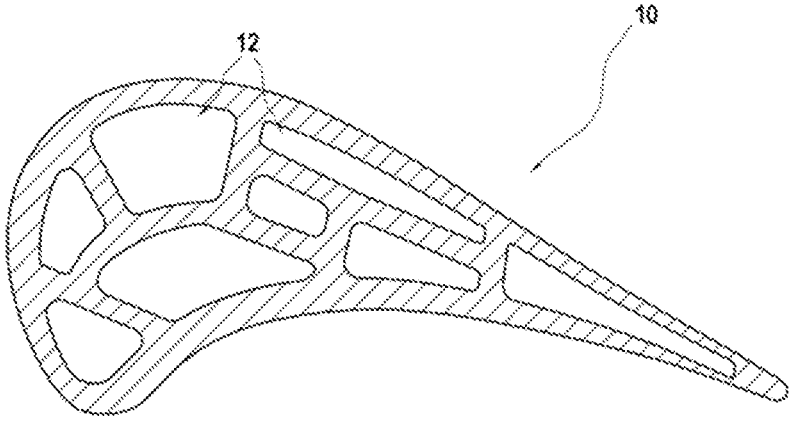

[Fig. 3]
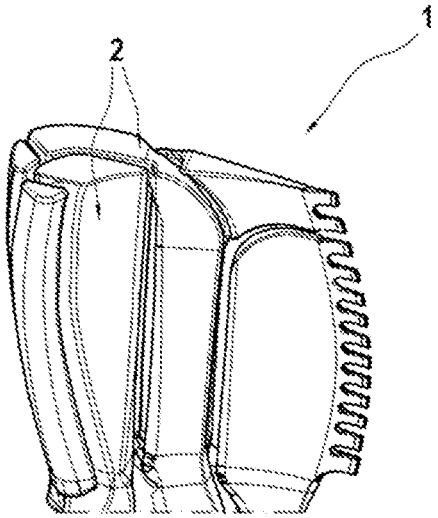
[Fig. 4]
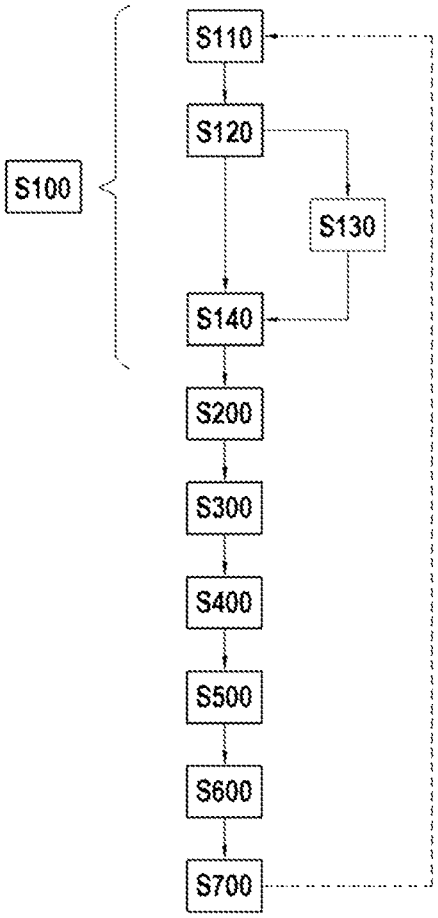

[Fig. 5]
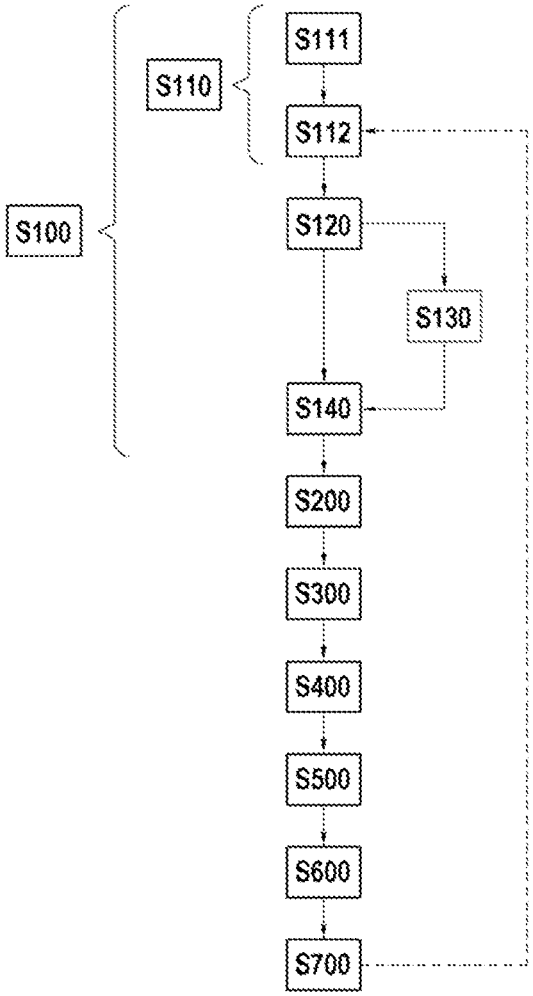

FOUNDRY CORE FOR MANUFACTURING A HOLLOW METAL AERONAUTICAL PART

CROSS-REFERENCE TO RELATED APPLICATIONS

This is a National Stage Application under 35 U.S.C. § 371 of International Application No. PCT/FR2022/051406, filed Jul. 12, 2022, now published as WO 2023/285766 A1, which claims priority to French Patent Application No. 2107726, filed on Jul. 16, 2021.

TECHNICAL FIELD

The invention relates to the manufacture of hollow metal aeronautical parts, in particular aeronautical turbomachine blades, by lost-wax casting methods. More precisely, the invention relates to the casting core used in the manufacture of hollow aeronautical parts, to a method of manufacturing such a casting core, and to a method of manufacturing such an aeronautical part.

PRIOR ART

Metal aeronautical parts, in particular nickel-based high-pressure turbine blades, generally feature internal cooling channels, making these parts hollow.

In a known manner, these hollow parts are produced by so-called "lost-wax" casting methods, using ceramic cores to form the internal cavities forming the cooling channels on the final part. These methods generally comprise the following steps:

- manufacturing ceramic cores, for example by ceramic injection and sintering,
- Injecting wax patterns (injecting wax around the core),
- assembling the models and manufacturing the shell mold,
- dewaxing to remove the wax and make room for the alloy, followed by a shell mold firing step,
- vacuum casting of nickel-based alloys and controlled solidification,
- mechanical knockout of the shell and chemical knockout of the cores, e.g., by dissolution, to obtain the final blade with an internal cavity.

Current research and development efforts are aimed at increasing the performance of aero-engines, and reducing $CO_2$ emissions and specific fuel consumption. To this end, it is necessary to develop high-pressure turbine blade technologies that increase the turbine inlet temperature (TIT). To achieve a higher TIT, new technologies are being introduced, including new higher-temperature single-crystal materials, new protective coatings compatible with new alloys, or new thermal barriers with reduced thermal conductivity and resistance to environmental aggression.

Cooling circuits in particular play a major role in achieving these objectives. Consequently, the complexity of these circuits tends to increase, integrating very thin and long sections. As a result, these circuits can be difficult to manufacture. Indeed, given the brittleness of the ceramic composition used and the need to use demoldable shapes, the production of such circuits by ceramic injection into a mold, which is the method generally used to manufacture casting cores, can be laborious and costly, with a high scrap rate in particular.

On the other hand, the chemical knockout of these complex circuits also presents drawbacks both from an environmental and industrial point of view (handling of highly dangerous solvents), and from the point of view of the efficiency of this method step, which may be limited in particular by the complexity and/or accessibility of the etching fluids. In addition, the increasing complexity of the cooling channels leads to an increase in knockout time as well as treatment temperatures and pressures, which can ultimately increase the risk of chemical interaction between the superalloy and the bases/acids used. Finally, the material used to make these cores is not reusable and cannot be regenerated at the end of the method.

At present, there are a number of solutions that can help overcome some of these drawbacks. In particular, it is known to use refractory metal cores instead of ceramic cores, notably based on molybdenum-containing alloys. Although this technology makes it possible to reduce the thinness of the cooling channels and to obtain more complex shapes, it does not offer a solution to the other problems mentioned above, particularly those linked to recycling, the environment and the knockout of complex circuits. Moreover, molybdenum and its alloys oxidize at high temperatures and become brittle. These metals are therefore sensitive to core firing, shell annealing and superalloy casting. This degradation can lead to erosion of the material in contact with the superalloy, creating asperities on the inner surface of the blade and consequently undesirable fluidic disturbances, which can reduce the efficiency of cooling circuits. These metals are also soluble in the superalloy.

This drawback can be overcome by applying coatings to the refractory metal. However, in order to meet certain properties, such as chemical compatibility with the refractory metal, good adhesion to the latter, being able to be knocked out and having a coefficient of thermal expansion close to that of the refractory metal, these coatings must be composed of several layers, and the methods for producing these coatings remain complex.

There is therefore a need for a solution that at least partially alleviates the above-mentioned drawbacks.

DISCLOSURE OF THE INVENTION

The present disclosure relates to a casting core for the manufacture of hollow metal aeronautical parts, in particular high-pressure turbine parts by lost-wax casting, comprising a composite material comprising on the one hand a first phase of formula $M_{n+1}AlC_n$, where n=1 to 3 and M being a transition metal selected from the group consisting of titanium and/or niobium and/or molybdenum, the composite material comprising on the other hand a second phase of formula $Al_4C_3$.

It is understood that the first phase is of the "MAX phase" type, a crystalline structure of generic formula $M_{n+1}AX_n$, combining characteristics of both metals and ceramics, and in particular exhibiting good thermal and electrical conductivity, good machinability, as well as damage tolerance and resistance to oxidation at high temperatures. It is further understood that the phrase "for the manufacture of hollow metal aeronautical parts" means that the core is adapted and suitable for the manufacture of such metal parts. Nevertheless, it is understood that this application is not limitative, as a core with the same composition may also be suitable for the manufacture of ceramic matrix composite (CMC) parts, in particular.

In the present disclosure, the use of aluminum at site A ensures either the formation of a protective alumina layer by core oxidation, or compatibility with any aluminoformer coatings deposited on the core. In addition, the use of carbon at site X is advantageous in that the carbide-type phases thus formed have a melting temperature in excess of 1500° C., and therefore higher than the melting temperature of the metal used during casting of the molten metal in the shell mold. Carbon also makes it possible to form phases that are chemically compatible with $Al_4C_3$. Furthermore, the titanium and/or niobium and/or molybdenum used at site M, in coordination with the use of carbon, enable phases to be obtained with melting temperatures higher than that of the metal used during casting, and also with good mechanical properties up to at least 1500° C.

In addition, the combination of this first phase with a second phase of formula $Al_4C_3$, is particularly advantageous. Aluminum carbide ($Al_4C_3$) is an inorganic compound with a very high melting point (2200° C.), which can easily be hydrolyzed at room temperature in the presence of a water-rich atmosphere. Thus, the composite material used for the casting core of the present disclosure incorporates this second phase of aluminum carbide at the grain boundaries of the first phase. This makes the composite material particularly reactive to water-containing atmospheres. Degradation of the aluminum carbide is accompanied by a change in volume and the release of gas, which can fragment the grain boundary and propagate cracks in the initial first phase. In this way, the hydrolysis phenomenon can be propagated over relatively long distances, facilitating core fragmentation and knockout. In other words, the composite material forming the core can be dense and massive initially, and reduced to powder by hydrolysis.

On the other hand, the chemical gradient between the aluminum carbide and the first phase containing aluminum and carbon is very limited, thus limiting interdiffusion between the different chemical elements during the core shaping and casting steps. In addition, once the core has been knocked out, a fragmented material composed of grains of the first phase and hydrated aluminum can be recovered. After drying, this material can be "recharged" with $Al_4C_3$ and reused to manufacture new casting cores.

The composite material of the casting core according to the present disclosure thus combines the aforementioned advantages associated with the refractory compounds of the first phase, with the use of a second phase of formula $Al_4C_3$, enabling the production of hollow structures of complex shapes, while allowing easy and rapid knockout of thin cores, without having to resort to chemical solutions that are potentially harmful to the part subsequently manufactured and to the environment, and which can be recycled.

In some embodiments, the first phase is of one of the formulae among $Nb_4AlC_3$, $Nb_2AlC$, $Mo_2TiAlC_2$ or $Ti_2AlC$.

The $Ti_2AlC$ phase is aluminoforming and therefore does not require the addition of a coating to form this protective layer. Its thermal expansion coefficient is of the order of 7-9×10−6 $K^{-1}$, which is close to that of alumina, and prevents the oxide formed from scaling at high temperatures.

The $Nb_4AlC_3$, $Nb_2AlC$ and $Mo_2TiAlC_2$ phases are not aluminoforming. It is preferable to add a coating to form this protective layer. Nevertheless, their thermal expansion coefficient is also of the order of 7-9×10−6 $K^{-1}$, which is close to that of alumina, and therefore allows the direct deposition of a layer of alumina or an aluminoforming coating.

These phases make it possible to dispense with time-consuming multilayer deposition. They are also refractory phases with a mechanical strength close to that of the ceramics used, but with better ductility than the latter, making them easier to use.

In some embodiments, the composite material comprises between 1 and 50% second phase by volume of the composite material, preferably between 1 and 20%. These values ensure fragmentation of the composite material by hydrolysis, while leaving a sufficient volume of first phase in the composite material, enabling the technical advantages associated with this first phase to be retained. In addition, this $Al_4C_3$ phase fraction ensures the chemical stability of the material at high temperatures, while at the same time allowing hydrolysis to be induced to facilitate knockout.

In some embodiments, an outer surface of the casting core is covered by a layer of alumina.

Core degradation, by hydrolysis of aluminum carbide in a water-containing atmosphere, should only take place when core knockout is carried out. In this way, the presence of an adherent, dense alumina layer on the surface of the core protects the composite material from degradation during the other steps in the manufacture of a casting part prior to core knockout, in particular during the dewaxing step.

In some embodiments, the alumina layer has a thickness of between 1 and 50 μm. This thickness makes it possible to protect the core during the manufacture of a casting part. More specifically, the alumina layer thus formed is thin enough not to have any impact on core removal by knockout, but chemically isolates the inner part of the core from the outside.

The present disclosure also relates to a method of manufacturing a casting core for making a hollow metal aeronautical part, in particular high-pressure turbine parts, by lost-wax casting, the casting core comprising a composite material comprising, on the one hand, a first phase of formula $M_{n+1}AlC_n$, where n=1 to 3 and M being a transition metal selected from the group consisting of titanium and/or niobium and/or molybdenum, the composite material also comprising a second phase of formula $Al_4C_3$, the casting core being obtained by a powder metallurgy process comprising a mixing step in which powders for obtaining the composite material are mixed, and a shaping step.

The powder mixture used to obtain the composite material may comprise a mixture of pure powders of carbon, aluminum, titanium and/or titanium carbide, and/or niobium, and/or niobium carbide and/or molybdenum and/or $Al_4C_3$ aluminum carbide. In other words, the composite material constituting the casting core is obtained by reacting the various powders of the constituent elements of this material at high temperature. The advantage of this method is that the $Al_4C_3$, phase is involved in the production of the composite material, providing the necessary Al and C elements, thus offering the aforementioned advantages.

In addition, the shaping step can comprise the injection of a binder onto a powder called "binder jetting", the injection of a mixture of metal powder and a thermoplastic polymer called "Metal Injection Molding" (MIM), or any other suitable known 3D printing process, preferably followed by conventional debinding and/or sintering, or non-conventional debinding and/or sintering such as SPS (Spark Plasma Sintering), for example.

In some embodiments, the mixing step comprises mixing pure powders constituting the first phase to obtain the first phase in powder form, then mixing said first phase in powder form with an $Al_4C_3$ powder to obtain the second phase.

In other words, pure powders of carbon, aluminum, titanium and/or titanium carbide, and/or niobium, and/or niobium carbide, and/or molybdenum, and/or aluminum carbide are mixed first, to obtain the first phase, and then the first phase obtained is mixed with an aluminum carbide powder in a second step, to obtain the second phase. This improves control over the proportions of each phase.

In some embodiments, the mixing step comprises mixing pure powders constituting the first phase with excess $Al_4C_3$ powder to form the composite material in a single operation.

In other words, according to this configuration, powder mixing is not carried out in two steps (firstly, production of the first phase, then mixing with aluminum carbide powder), but the aforementioned pure powders are mixed in the same operation with an excess of $Al_4C_3$ powder, i.e., in over-stoichiometry, enabling the composite material to be formed "in situ". By reacting the $Al_4C_3$ powder in over-stoichiometry with the desired first phase, it is possible to maintain a controlled volume fraction of this phase in the final material.

In some embodiments, the first phase is of the formula $Ti_2AlC$, the method comprising, after the casting core shaping step, a core oxidation step enabling the formation of an alumina layer on a core surface.

As mentioned previously, the $Ti_2AlC$ phase is aluminoforming, and thus enables the formation of an alumina layer by simple oxidation of the core, without requiring the addition of a complex multi-layer coating to form this protective layer. However, this core degradation step can only be activated once the casting has been completed. This oxidation step produces an adherent, dense alumina layer on the surface of the core to protect the composite material from degradation, particularly during the dewaxing step. It should also be noted that, as the subsequent metal casting step is carried out in a vacuum, it poses no particular problem with regard to these materials.

In some embodiments, the first phase is of one of the formulae $Nb_4AlC_3$, $Nb_2AlC$ and $Mo_2TiAlC_2$, the method comprising, after the casting core shaping step, a step of depositing an aluminoforming coating, followed by a step of oxidizing the coating to form a layer of alumina on a surface of the core.

As mentioned previously, these phases are not aluminoforming, and therefore require the addition of a coating to form this protective layer. Nevertheless, these phases are compatible with aluminoforming coatings capable of forming an alumina layer by oxidation. It is thus possible to form a protective alumina layer in a simple manner, without requiring the addition of a complex multi-layer coating to form this protective layer.

In some embodiments, the oxidation step is performed by placing the core in an enclosure under air between 1000° C. and 1400° C.

The present disclosure also relates to a lost-wax casting method for manufacturing a hollow metal aeronautical part, in particular a high-pressure turbine part, using a casting core obtained by a method according to any of the preceding embodiments, the method comprising, after steps of casting a molten metal around the casting core and solidifying said metal, a step of knockout the casting core by steaming.

In other words, once the metal has solidified in a ceramic mold and around the casting core, the whole assembly is placed in a device, such as an oven, preferably with controlled humidity. As already mentioned, the presence of the $Al_4C_3$ phase between the grain boundaries enables the casting core to disintegrate in water-laden air. This facilitates knockout, and in particular improves the knockout of very fine channels, while avoiding the use of chemical solutions, such as acids, potentially harmful to the part being manufactured.

In some embodiments, the method comprises, prior to the knockout step, a step in which an opening is made in the part.

More precisely, the casting devices are eliminated and an opening is made in the part without the alumina layer. This further facilitates core knockout, as the degraded composite material can be discharged through this opening.

In some embodiments, the method comprises a recovery step following the knockout step, in which the material knocked out by steaming is recovered so that it can be reused in the manufacture of another casting core, starting again from the mixing step.

In other words, once core degradation has taken place, a fragmented material composed of grains of the first phase and hydrated aluminum can be recovered.

After drying, this material can be "recharged" with $Al_4C_3$ in the mixing step and thus reused to manufacture new cores. In this way, it is possible to recycle the discharged casting core, thereby meeting at least part of the above-mentioned environmental concerns.

The present disclosure also relates to a method of manufacturing a ceramic matrix composite hollow aeronautical part using a core obtained by a method according to any of the preceding embodiments, the method comprising, after steps of inserting the core into a fibrous preform, impregnating a ceramic matrix into the fibrous preform and solidifying the matrix, a step of knockout the core by steaming. It should be noted that the casting core obtained by a method according to the present disclosure is more simply referred to as a "core" when used for the manufacture of ceramic matrix composite (CMC) parts.

BRIEF DESCRIPTION OF THE DRAWINGS

The invention and its advantages will be better understood on reading the following detailed description of various embodiments of the invention given by way of non-limiting examples. This description refers to the attached pages of figures, on which:

FIG. 1 shows a perspective view of a high-pressure turbine hollow metal blade, FIG. 2 shows a cross-section of the blade shown in FIG. 1, FIG. 3 is a perspective view of a casting core according to the present disclosure, FIG. 4 shows schematically the steps of a method for manufacturing a hollow metal part according to a first embodiment in accordance with the present disclosure, FIG. 5 shows schematically the steps of a method of manufacturing a hollow metal part according to a second embodiment as described herein.

DESCRIPTION OF THE EMBODIMENTS

FIG. 1 shows a perspective view of a hollow high-pressure turbine blade 10, and FIG. 2 shows a cross-sectional view of said blade 10, showing the various cooling circuits 12 within said blade 10.

Such a blade is obtained, according to the present disclosure, by a lost-wax casting method. In particular, the cooling circuits 12 are obtained by using, during the manufacturing method, a casting core 1, manufactured in a preliminary step of the method, and having a shape corresponding to that of the cooling circuits 12 to be formed.

Such a casting core 1, according to the present disclosure, is shown in perspective on FIG. 3. Some portions 2 of this core 1, allowing to obtain the various cooling channels 12, are complex or thin. Nevertheless, the casting core 1 according to the present disclosure comprises a composite material to facilitate removal of this core 1, during the knockout step described later.

The composite material comprises two phases: a first phase known as the "MAX phase", and a second phase with the formula $Al_4C_3$, i.e., aluminum carbide MAX phases are so-called stoichiometric materials, known per se, of the formula: $M_{n+1}AX_n$, with n=1 to 3, M being a transition metal, A an element from group A and X carbon and/or nitrogen.

In the present disclosure, the element used in group A is aluminum (Al) to ensure either the formation of an alumina layer when aluminoforming phases are used, or compatibility with subsequently deposited aluminoforming coatings. The element used at site X is carbon (C). Phases containing nitrogen (N) often have lower melting temperatures than their carbon-containing counterparts, and chemical compatibility with the $Al_4C_3$ phase is not guaranteed. Finally, the element used at site M is determined so that the resulting material has a melting point above 1500° C. MAX phases based on chromium (Cr), such as $Cr_2AlC$ for example, are not suitable for the present application, as they start to decompose around 1500° C. Similarly, zirconium (Zr)-based MAX phases have too low a melting point, notably below 1500° C.

Thus, in the application of the present disclosure, the first phase used can be of formula $Nb_4AlC_3$, $Nb_2AlC$, $Mo_2TiAlC_2$ or $Ti_2AlC$.

The second phase, of formula $Al_4C_3$ is a well-known carbide with a very high melting point (2200° C.). It is also aluminoforming at high temperatures. However, a particularly advantageous property of the invention is the ease with which this phase hydrolyzes at room temperature in the presence of a water-rich atmosphere. The decomposition of this phase proceeds according to the following reaction: $Al_4C_3+12H_2O \rightarrow 4Al(OH)_3+3CH_4$ This reaction can be catalyzed by optimizing both hygrometry and temperature.

Thus, given the presence of the second phase of formula $Al_4C_3$, between the grain boundaries of the first phase, the casting core 1 comprising this composite material can be easily eliminated by being degraded by hydrolysis, at the end of the blade manufacturing method.

In this respect, the blade manufacturing method according to the present disclosure is a lost-wax casting method. The various steps of this method, according to a first embodiment, are shown in FIG. 4.

The first step S100 of this method consists in manufacturing the casting core 1 described above, intended for subsequent use in the manufacture of hollow turbomachine blades using the lost-wax casting technique. The casting core 1 thus produced in step S100 is placed in a wax mold, held in a predetermined position, so as to inject wax around the core to form the wax pattern having the shape of the final part (step S200). After removal from the wax mold, the wax pattern is then dipped several times in a slurry-cast to form a ceramic mold (step S300). Once the wax has been removed (step S400), e.g., by placing the assembly in an autoclave oven, the molten metal, e.g., nickel-based alloys, is poured into the ceramic mold and around the ceramic core, the latter again being held in a fixed position inside the ceramic mold, and the metal is then solidified by controlled solidification (step S500). Finally, the ceramic mold and casting core 1 are removed by knockout, to obtain the final part (step S600).

In accordance with the present disclosure, step S100 for manufacturing the casting core 1 is divided into several steps. Firstly, metal powders are mixed together to form a composite powder comprising the first and second phases (step S110). In the first step, pure aluminum (Al), carbon (C), niobium (Nb) and/or niobium carbide (NbC) and/or molybdenum (Mo) and/or titanium (Ti) and/or titanium carbide (TiC) powders are mixed with excess $Al_4C_3$ aluminum carbide powder, so as to form in situ a composite material comprising the first phase and the second phase, such that the second phase represents between 1 and 50%, preferably between 1 and 20%, of the total volume of the composite material.

Once the mixing step has been completed, the casting core 1 is shaped (step S120) to the desired form. This step can be carried out by various known methods, such as binder jetting, injection of a mixture of metal powder and a thermoplastic polymer, (also known as Metal Injection Molding or MIM), or any other suitable known 3D printing process, preferably followed by conventional debinding and/or sintering, or non-conventional debinding and/or sintering such as SPS (Spark Plasma Sintering), or any other suitable known method, or a combination of these methods.

This is followed by an alumina layer formation step, to form an alumina layer with a thickness of between 1 and 50 μm (step S140). This step is carried out by oxidizing the casting core 1 by heating it to a temperature of between 100° and 1400° C. However, depending on the first phase used in the composite material, a preliminary step to this oxidation step may be necessary. As previously mentioned, phases of the formulae $Nb_4AlC_3$, $Nb_2AlC$ and $Mo_2TiAlC_2$ are not aluminoforming, so that heating a core 1 comprising a composite material with one of these first phases to a temperature of between 100° and 1400° C. will not result in the formation of an alumina layer. Consequently, in this case, core shaping step S120 is followed by an alumina-forming coating deposition step (step S130).

For example, a layer of molybdenum (Mo) can be deposited directly on the core by thermal spraying. Silicon (Si) and aluminum are then deposited by pack-cementation at 1100° C. After a treatment in air at 1200° C. for a few hours, an alumina layer is formed on the surface. Alternatively, aluminum can be deposited directly by cementation or sol-gel, followed by oxidation under air at 1100° C. This alumina-forming coating can also be deposited by known techniques such as chemical vapor deposition (CVD), physical vapor deposition (PVD) or dip coating, for example. Once the alumina-forming coating has been deposited, step S140, which forms the alumina layer by oxidation, can be carried out under the aforementioned conditions.

In contrast, the $Ti_2AlC$ phase is aluminoforming. Consequently, when the latter is used for the first phase of the composite material, step S120 for shaping the core 1 can be followed immediately by step S140 for forming the alumina layer by oxidation, without the need for a prior coating deposition step.

The casting core 1 thus obtained, comprising an alumina layer on its outer surface, can then be used in the lost-wax casting method for manufacturing parts described above, in particular in step S200 for injecting wax around core 1 to form the wax pattern. The internal structure of core 1 will not be affected by the wax removal step (step S400), due to the presence of the alumina layer on its outer surface.

Alternatively, the above-mentioned step S600, comprising the knockout of the casting core 1, can be carried out by placing the assembly in a humidity-controlled oven (relative humidity RH>50%) or preferably in a steam autoclave, at temperatures of between 10° and 180° C., and pressures of between 6 and 12 bar. Applying pressure accelerates the knockout kinetics, while facilitating access of vapors to the thin sections. This step is preferably preceded by a step to form an opening in the part, to facilitate evacuation of the core 1 degraded by hydrolysis in the aforementioned oven.

It should be noted that during this step, the alumina layer may be evacuated along with the degrading composite, or may also remain adhered to the nickel-base superalloy, offering protection against internal oxidation of the cooling channels.

Finally, knockout step S600 can be followed by a recovery step (step S700), or recycling, in which the composite material knocked out by steaming, then in powder form, is recovered so as to be reused for the manufacture of another casting core 1, starting again from mixing step S110. More precisely, once the core has been degraded, a fragmented material composed of grains of the first phase and hydrated aluminum is recovered. After drying, this material can be "recharged" with $Al_4C_3$ and reused to manufacture new casting cores 1.

The various steps in a lost wax casting method for manufacturing blades, according to a second embodiment of the present disclosure, are shown in FIG. 5.

The method according to the second embodiment differs from the method according to the first embodiment in that powder mixing step S110 is divided into two sub-steps. Whereas in the first embodiment, the mixing step is carried out in a single operation, in which the composite material is formed in situ by the presence of excess $Al_4C_3$, phase, the S110 powder mixing step in the second embodiment comprises firstly mixing the pure powders making up the first phase to obtain the first phase (step S111), then mixing the first phase thus obtained with an $Al_4C_3$ powder to obtain the composite material ex situ (step S112).

For example, in step S111, a first phase of formula $Nb_4AlC_3$ can be obtained by mixing pure niobium, aluminum and niobium carbide powders (Nb:Al:NbC) in molar proportions of 1.2:1.1:2.8 respectively. In this case, the niobium grains have a diameter of less than 44 μm, a purity of 99.8%, and a density of 8.57 g/cm$^3$. The aluminum grains have a diameter of less than 44 μm, a purity of 99.5%, and a density of 2.70 g/cm$^3$, and the niobium carbide grains have a diameter of less than 10 μm, a purity of 99%, and a density of 7.82 g/cm$^3$. These different powders can be mixed in an attritor and in a solvent (e.g., ethanol), then subjected to drying and reactive sintering up to 1700° C. The resulting porous mass is ground to powder.

By way of further example, in step S111, a first phase of formula $Ti_3AlC_2$ can be obtained by mixing pure titanium, aluminum and titanium carbide powders (Ti:Al:TiC) in molar proportions of 1:1.05:1.9 respectively. In this case, the titanium grains have a diameter of less than 45 μm and a purity of 99.5%. The aluminum grains have a diameter of between 45 and 150 μm, a purity of 99.5% and the titanium carbide grains have a diameter of 2 μm, a purity of 99.5%, and a density of 7.82 g/cm$^3$. These different powders can be mixed in a ball mill, then subjected to reactive sintering up to 1450° C. The resulting porous mass is ground to powder.

It should also be noted that, in step S111, the pure powders can also be mixed with $Al_4C_3$ powder. In this case, the $Al_4C_3$ powder contributes to the formation of the first phase, but is not in sufficient quantity to form the composite material in situ, so that the second step S112 is necessary, and makes it possible to add a necessary quantity of $Al_4C_3$, powder, making it possible to obtain the previously mentioned proportions of $Al_4C_3$ in the composite material.

Even though the present invention has been described with reference to specific embodiments, it is obvious that modifications and changes can be made to these embodiments without departing from the general scope of the invention as defined by the claims. In particular, individual features of the various illustrated/mentioned embodiments may be combined in additional embodiments. Consequently, the description and drawings are to be considered in an illustrative rather than restrictive sense.

It is also clear that all features described with reference to a method are transposable, alone or in combination, to a device, and conversely, all features described with reference to a device are transposable, alone or in combination, to a method.

The invention claimed is:

1. A casting core for the manufacture of hollow metal aeronautical parts comprising a composite material comprising on the one hand a first phase of formula $M_{n+1}AlC_n$, where n=1 to 3 and M being a transition metal selected from the group consisting of titanium and/or niobium and/or molybdenum, the composite material comprising on the other hand a second phase of formula $Al_4C_3$.

2. The casting core according to claim 1, wherein the first phase is of one of the formulae among $Nb_4AlC_3$, $Nb_2AlC$, $Mo_2TiAlC_2$ or $Ti_2AlC$.

3. The casting core according to claim 1, wherein the composite material comprises between 1 and 50% second phase by B volume of the composite material.

4. The casting core according to claim 1, wherein an outer surface of the casting core is covered by a layer of alumina.

5. The casting core according to claim 4, wherein the alumina layer has a thickness of between 1 and 50 μm.

6. The casting core according to claim 1, wherein the composite material comprises between 1 and 20% second phase by volume of the composite material.

7. A method of manufacturing a casting core for making a hollow metal aeronautical part the casting core comprising a composite material comprising, on the one hand, a first phase of the formula $M_{n+1}AlC_n$, where n=1 to 3 and M being a transition metal selected from the group consisting of titanium and/or niobium and/or molybdenum, the composite material also comprising a second phase of formula $Al_4C_3$, the casting core being obtained by a powder metallurgy process comprising a mixing step in which powders for obtaining the composite material are mixed, and a shaping step.

8. The method according to claim 7, wherein the mixing step comprises mixing pure powders constituting the first phase so as to obtain the first phase in powder form, then mixing said first phase in powder form with an $Al_4C_3$ powder so as to obtain the second phase.

9. A The method according to claim 7, wherein the mixing step comprises mixing pure powders constituting the first phase with excess $Al_4C_3$ powder so as to form the composite material in a single operation.

10. The method according to claim 7, wherein the first phase is of the formula $Ti_2AlC$, the method comprising, after the casting core shaping step, a core oxidation step enabling the formation of an alumina layer on a core surface.

11. The method according to claim 7, in which the first phase is of one of the formulae $Nb_4AlC_3$, $Nb_2AlC$ and $Mo_2TiAlC_2$, the method comprising, after the step of shaping the casting core, a step of depositing an aluminoforming coating, followed by a step of oxidizing the coating to form a layer of alumina on a surface of the core.

12. A lost-wax casting method for manufacturing a hollow metal aeronautical part, in particular a high-pressure turbine part, using a casting core obtained by the method according to claim 7 the method comprising, after steps of casting a molten metal around the casting core and solidifying said metal, a step of knockout the casting core by steaming.

13. The method according to claim 12, comprising, prior to the knockout step, a step in which an opening is made in the part.

14. The method according to claim 12, comprising, after the knockout step, a recovery step, in which the material knocked out by steaming is recovered so as to be reused for the manufacture of another casting core starting again from the mixing step.

15. A method of manufacturing a ceramic-matrix composite hollow aeronautical part using a core obtained by the method according to claim 7, the method comprising, after steps of inserting the core into a fibrous preform, impregnating a ceramic matrix into the fibrous preform and solidifying the matrix, a step of knockout the core by steaming.

* * * * *